United States Patent [19]

Sullivan

[11] 4,278,711

[45] Jul. 14, 1981

[54] APPARATUS AND METHOD FOR THE LUBRICATION OF CANS

[75] Inventor: Richard W. Sullivan, Denver, Colo.

[73] Assignee: Ball Corporation, Muncie, Ind.

[21] Appl. No.: 112,011

[22] Filed: Jan. 14, 1980

[51] Int. Cl.[3] ..... B05D 1/02; B05D 3/12

[52] U.S. Cl. ..... 427/284; 118/107; 118/109; 118/314; 118/315; 118/320; 118/322; 118/684; 239/566; 239/567; 427/355; 427/424; 427/425

[58] Field of Search ..... 118/107, 109, 314, 315, 118/320, 322, 684, DIG. 3; 427/421, 286, 424, 284, 355, 425; 239/8, 566, 567, 369

[56] References Cited

U.S. PATENT DOCUMENTS

| | | | |
|---|---|---|---|
| 570,538 | 11/1896 | Burns | 118/107 |
| 2,039,280 | 5/1936 | Brogden | 118/320 X |
| 2,197,742 | 4/1940 | Burk | 118/320 X |
| 2,334,087 | 11/1943 | Goebel et al. | 118/322 |
| 3,702,107 | 11/1972 | Rood et al. | 118/684 |
| 3,989,001 | 11/1976 | Brigham | 118/314 X |
| 3,990,395 | 11/1976 | Evans et al. | 118/109 X |

*Primary Examiner*—Shrive P. Beck
*Attorney, Agent, or Firm*—Nicholas T. Bokides

[57] ABSTRACT

A method and apparatus are disclosed for applying a light coating of fluid to the outer surface of a circumferential strip of one end of a cylindrically shaped article. The article is stabilized against angular axial movement while being advanced and rotated, in a planar path, through a treating zone. An airborne mist containing fine particles of the fluid is produced. This mist is transported to the treating zone and directed to impinge upon said circumferential strip. The impinged fluid mist is then leveled to achieve a uniform coating.

26 Claims, 4 Drawing Figures

APPARATUS AND METHOD FOR THE LUBRICATION OF CANS

BACKGROUND OF THE INVENTION

This invention pertains to the art of can manufacturing and, more particularly, to an apparatus and method for lubricating the outside peripheral surface of a circumferential strip at the open end of a can.

The open end of a cylindrical metal can is commonly reduced in diameter and flanged. This process of reducing the diameter of a can is generally referred to as necking. The reduction in diameter lessens the amount of material needed for a closure and the flange facilitates attaching the closure to the can.

A common method of necking a can requires the employment of a necking die. A lubricant is applied to the outer peripheral surface of the circumferential strip at the open end of the can. The open end is then forced into the tapered necking die resulting in plastic deformation of the open end to a smaller diameter or neck. In a production line situation, a single necking die may perform this operation on over 800 cans per minute. Unless a sufficient lubricant coating is present on the outside surface of the can, substantial frictional forces will be generated in the necking operation. These frictional forces may result in excess die wear, generation of metal particles or fragments from the can, impact welding of the particles to the die, scratching of the can surface and in extreme cases, wrinkling, buckling, or fracturing of the can thereby producing an unusable can or causing production line stoppage. It is highly desirable to avoid even minor scratching of the flange portion of the can because of possible sealing problems when the end closure is attached. Also, it is to be understood that the metal cans herein disclosed are already decoratively coated by a primary coating such as paint, resin or the like and are thereafter brought into the process of the subject invention. Thus, the lubricant substantially aids in maintaining the integrity of the primary coating in the necking process. Purchasers of cans for packaging purposes insist that the integrity of this primary coating be maintained as it is considered a reflection on their product.

It is therefore imperative that sufficient lubricant coating be applied to the can. Although prior art apparatus and methods generally succeed in the application of a sufficient quantity of lubricant to the can, they are subject to a number of shortcomings.

Prior art lubrication apparatus have generally required the use of large quantities of an organic solvent as a carrier for the lubricant. Primarily, a hexane-lanolin or hexane-petrolatum mixture is used where the lubricant comprises about 2% of the mixture and the remainder is solvent. The mixture is applied to a container and the solvent rapidly evaporates leaving only the lubricant.

Hexane and other organic solvents so used are extremely flammable and pose a substantial health risk when used in the closed environment of a container manufacturing plant. A can line running at 850 cans per minute may use between 100 and 180 gallons of hexane per week, or up to 26 gallons per 24-hour period. Where there are two or more can lines in the same plant, the hexane used is proportionately increased. The advantages of eliminating hexane and other solvents from a lubrication system are apparent. Gallons of the substance are eliminated from the atmospheric environment and the cost of the solvent is avoided.

In the prior art the application of hexane-lubricant mixture is almost universally accomplished by various wicking devices. Besides usually requiring a volatile solvent as a carrier, the conventional wicking devices lack control over the quantity of lubricant applied to each can. This lack of control mandates that an excess of lubricant usually be applied to maintain an adequate margin of safety so that the above problems will be avoided.

The application of lubricant to the can by a wick system often involves some frictional forces between the can and the wick. A typical arrangement involves using dual belt drives, one on each side of the container, in conjunction with a long staionary wick. One belt drive rotates at a greater speed than the other. Due to the slower turning belt, the container is actually rotated at a greater speed than would be necessary for a pure rolling motion which results in the container being spun on the wick as well as translated along the wick's length. Most of the prior art wick systems involve some dragging or spinning of the container on the wick. This dragging necessitates a high standard of machine maintenance and adjustment.

SUMMARY OF THE INVENTION

In accordance with the broader aspects of the present invention, there is provided a method and apparatus for applying a light coating of fluid to a circumferential strip near the open end of a cylindrical article by advancing and rotating said article through a treating zone, producing a mist of droplets of said fluid, directing said mist to impinge upon said article, and leveling said impinged mist of droplets. Furthermore, the present invention provides a method and apparatus for positioning two or more cylindrical articles in a spaced apart relationship and coating a cylindrical portion of said articles.

The primary use of the subject invention is in the lubrication of the end portion of cylindrical cans in preparation for a necking operation. In this application, pressurized air is supplied to an atomizer which produces a mist of airborne lubricant particles. This mist is then communicated to a manifold which distributes the mist along a lubrication zone.

An adjustment on the atomizer allows varying the quantity of lubricant which is dispersed per cubic unit of air. The quantity of mist which is delivered to the lubrication zone may be controlled by regulating the pressure of the air supplied to the atomizer. These two adjustments allow much greater control of the amount of lubricant distributed at the lubrication zone than was possible in the prior art.

Cans are transported through the lubrication zone by engaging a peripheral surface of the can with an advancing surface while the opposite peripheral surface of the can is in contact with a stationary rolling surface which supports the can away from the area to be necked and flanged. Optionally, the rolling surface may also be in motion in a direction opposite to and at a slower speed than the advancing surface. This latter arrangement increases the time period the can is exposed to the lubricant mist. In either case a constraining member at each end of the can controls the direction of travel.

The parallel rolling and advancing surfaces confine the travel of the can to a substantially planer path. The two constraining members stabilize the can against angular axial movement i.e., the axial orientation of the can remains parallel, throughout the lubricator, to the original axial orientation.

The manifold may take a number of configurations but satisfactory results are obtained with a length of conduit having a plurality of outlets. The conduit traverses the lubrication zone in close proximity to the path taken by the end portion of the can. Depending on the pressure differential across the conduit, the outlets may vary in size to achieve a substantially even distribution of lubricant along the manifold.

Generally the can is ready for filling after the necking and flanging operation and no further cleaning will be done. Therefore, to decrease the risk of contamination of the interior of the can with lubricant, the outlets are oriented at a predetermined angle of inclination to direct the lubricant mist away from the interior opening of the can.

A strip of absorbent material is positioned to contact the end portion of a can that is being rolled through the lubrication zone. This material levels the lubricant by spreading the lubricant deposited thereon and absorbing any excess lubricant from the can. The excess lubricant is taken up and redistributed on subsequent containers having a deficient coating.

A wide range of fluids or lubricating materials may be utilized in the subject invention including mineral oils, hydrocarbon waxes including parafinic, naphthenic, aromatic, and unsaturated hydrocarbons, esters of fatty acids, including gylcerides, silicate esters, fluoro-esters, phosphate esters, chlorofluorocarbon polymers and the like. Preferrably, the viscosity of the fluid should be low. For example, where mineral oils are employed the Saybolt unit viscosity should be between 85 and 250. Where more than one necking operation is to be performed on the can, a relatively heavier lubricant may be more effective as it will tend to resist being wiped off by prior operations.

In order to be effective for the particular conditions herein set forth the thickness of the applied fluid coatings should be such as to not be readily noticeable upon visual inspection. In an experimental run it was found that less than one quart of lubricant was used in a 24-hour period by a can line operating at about 800 cans per minutes. Therefore, less than one quart treats over one million cans. From the above test it should be apparent that the coating is exceedingly thin and barely tactile to one inspecting a treated can.

Accordingly, it is an object of this invention to eliminate the use of organic vapors, including hexane, in a can lubricator system along with the attendant health hazards, fire hazards and cost.

It is a further object of this invention to provide a simple method of applying, in an effective manner, any number of organic, carrier free lubricants to a moving body having curvilinear surfaces thereon.

It is a further object of this invention to provide a method of delivering a uniform and even coating of lubricant to preselected portions of a row of advancing cylindrical objects.

It is another object of this invention to reduce the amount of lubricant used and to provide an effective method of applying the same without dripping or splashing.

It is still another object to provide an apparatus for can lubrication with substantially decreased machine service and maintenance schedules.

For further understanding of the present invention and of the objects thereof, attention is directed to the drawings, the following description thereof, the detailed description of the invention, and the appended claims.

DETAILED DESCRIPTION OF AN ILLUSTRATIVE EMBODIMENT

Figure 2:
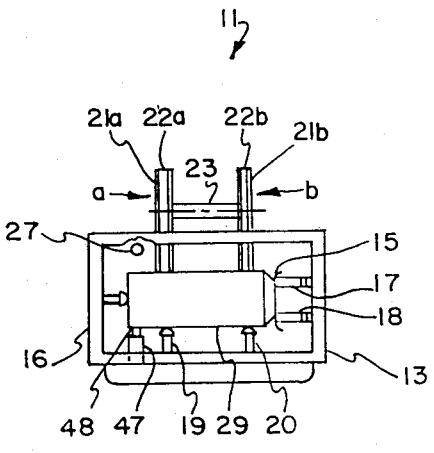
FIG. 2 is an end view of the apparatus in FIG. 1.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

Figure 1:
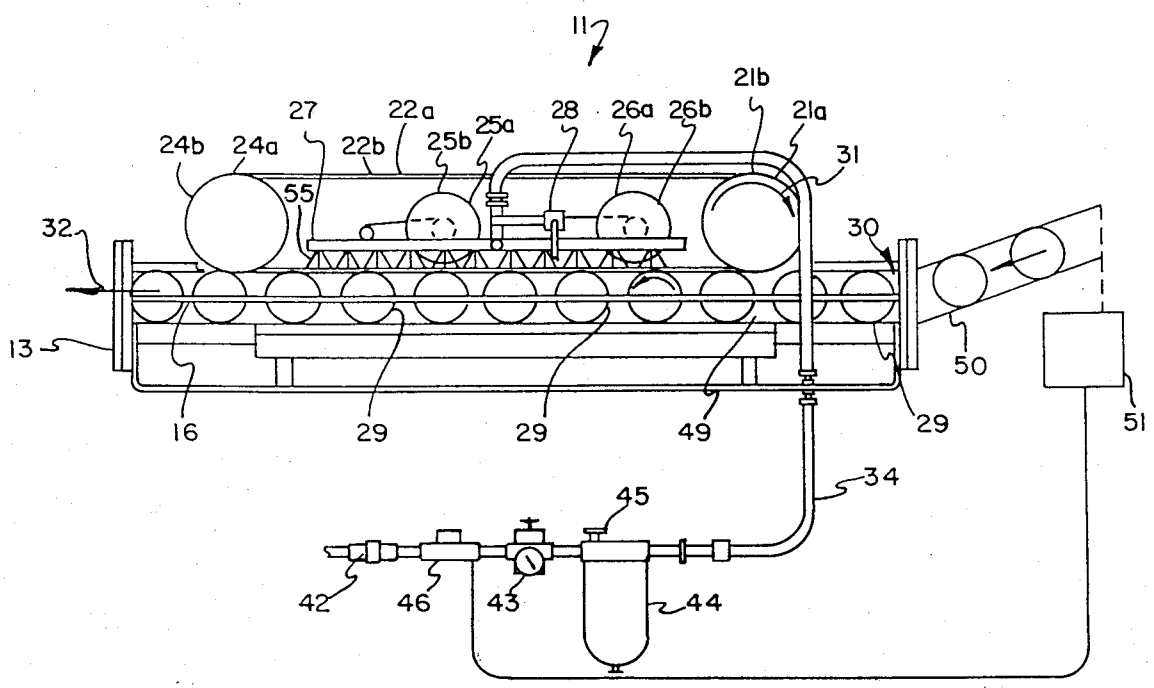
FIG. 1 is a side view of a preferred embodiment of the can lubricator.

FIGS. 1 and 2 show a can lubricator generally designated by the reference numeral 11. The can lubricator has a frame 13, which is provided with constraining members 15 and 16, and a stationary rolling surface consisting of rails 19 and 20. Constraining number 15 is supported by extensions 17 and 18 from frame 13 while constraining number 16 and stationary rolling surface 19 and 20 are directly attached to frame 13. In the preferred embodiment herein described, frame 13, constraining members 15 and 16, extensions 17 and 18, and rails 19 and 20, are part of the trackwork generally found in a can manufacturing facility.

A thin strip of absorbent material 48 is supported by material holder 47 which is attached to frame 13. Material holder 47 and absorbent material 48 extend the length of the can lubricator and are positioned such that the absorbent material 48 will contact the circumferential strips at the ends of cans 29 when the cans are rolled through the lubricator on stationary rolling surface 19 and 20.

Two synchronized drive belt systems are supported above rolling surface 19 and 20 by extensions (not shown) from frame 13. The components of each drive system are substantially identical in dimensions and relative position to the other, which in FIG. 1, results in some components of one system being hidden from view by the like components of the other system. To promote the written description of these systems, one system is generally designated by the letter a and the other system is generally designated by the letter b, as best shown in FIG. 2. Like components of each system will be referenced by the same numeral with the letter a or b following to denote the specific system intended.

Belts **22*a* and 22*b* are respectively supported by drive pulleys 21*a* and 21*b* at one end and by idler pulleys 24*a* and 24*b* at the other end. Two belt tensioning rollers, 25 and 26, are positioned along each belt with belt tensioning rollers 25*a* and 26*a* being positioned along belt 22*a* and with belt tensioning rollers 25*b* and 26*b* being positioned along belt 22*b*. A drive shaft, 23, is connected between drive pulleys 21*a*, and 21*b*** providing the means for synchronizing the movement of the two belt systems.

Figure 4:
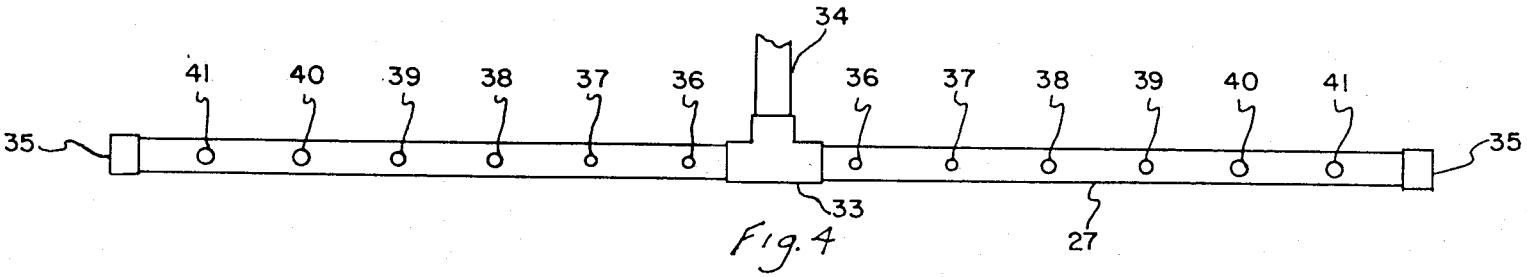
FIG. 4 is an enlarged view of a preferred embodiment of the manifold.

A manifold 27 is placed along the can lubricator and supported by bracket 28 from frame 13. A detailed illustration of the manifold is contained at FIG. 4. The manifold is constructed of conduit having approximately a 0.33 inch inner diameter and a length of about twice the circumference of the cans. Both ends of the conduit are sealed by end caps 35.

A series of outlets, which are the collinearly positioned holes referenced 36 through 41, are placed along the manifold at about 1.25 inch centers. Lubricant mist is directed from these holes in a spray distribution pattern referenced as 55. The diameters of these holes increase from the center of manifold 27 to both ends. Representative figures for the diameter of the holes are set forth.

| Hole | Diameter In Inches |
|---|---|
| 36 | .062 |
| 37 | .062 |
| 38 | .078 |
| 39 | .078 |
| 40 | .093 |
| 41 | .093 |

Figure 3:
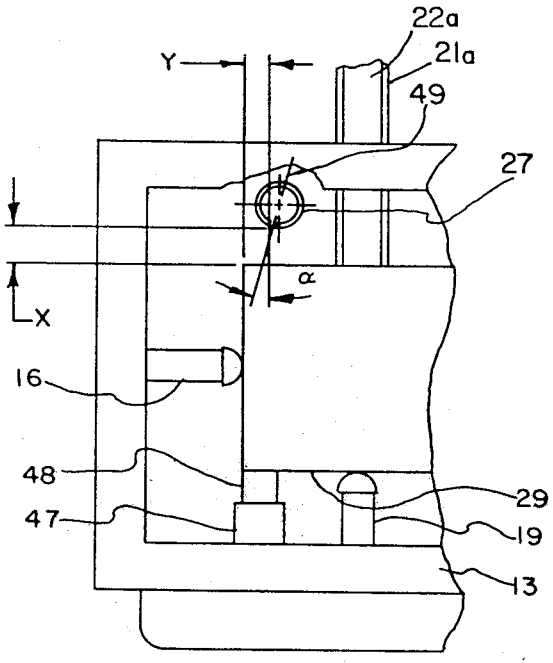
FIG. 3 is an enlarged view of a portion of FIG. 2 showing the positioning and orientation of the manifold.

The position of the manifold is determined relative to cans 29 which are supported by stationary rolling surface 19 and 20. Referring to FIG. 3, the holes on manifold 27 will be a first predetermined distance x above the peripheral surface of cans 29 and a second predetermined distance y in a direction parallel to the longitudinal axis of rotation of cans 29, and away from the terminal edge of said cans. The holes are oriented at an angle of inclination referenced as $\alpha$ which is defined as the angle between vertical and a construct drawn perpendicular to the peripheral surface of the manifold at the centerpoint of holes 36 to 41. Angle of inclination $\alpha$, first predetermined distance x and second predetermined distance y are interrelated and are also dependent on the distribution pattern of the outlets in the manifold, the size of the circumferential strip which is to be lubricated, and the characteristics of the atomizer and air pressure system. Normally, angle of inclination $\alpha$ will be between 0° and 25°, first predetermined distance x will be between $\frac{1}{8}$ and 1 inch, and second predetermined distance y will be between 0 and 1 inch.

The air system for the can lubricator is shown in FIG. 1. Pressurized air is supplied to air inlet 42 and flows through solanoid shut-off valve 46 to air pressure regulator 43 and into fluid atomizer 44. Hollow member 34 places the fluid atomizer into communication with manifold 27. A can sensing means 51 is placed in the can line at some point prior to the entrance 30 to the can lubricator. This sensing means activates the solenoid shut-off valve when no cans are present thereby turning off the air supply to fluid atomizer 44.

The appropriate air pressure is of course dependent on the overall design characteristics of the air system including inlet 42, atomizer 44, hollow member 34, manifold 27, the desired distribution patter 55, and the size, spacing, and number of outlets on said manifold. Excessive air pressure will result in a greater than necessary amount of lubricant being deposited on the cans while if the pressure is too low, the cans will be insufficiently coated. In the disclosed preferred embodiment, an air pressure of between about 15 and 20 psi (pounds per square inch) has been observed to achieve satisfactory results in the conservation of lubricant while depositing an adequate quantity of lubricant on the cans.

In operation, any conventional can transport means may be used to deposit cans at entrance 30. One of the simplest methods of introducing cans to the lubricator is through a gravity feed. The cans are placed on conventional trackwork 50 which slopes downward to entrance 30. Where the can lubricator is operated in a horizontal orientation, the momentum of the cans traveling down the trackwork will carry them through entrance 30, across the horizontal portion of the trackwork, to the point of engagement with the synchronized belt drive systems at 49. Furthermore, should the cans have insufficient momentum to travel across said horizontal portion of the trackwork, the weight of the column of cans in the downward sloping trackwork 50 will force lower positioned cans through entrance 30 to point of engagement 49.

Upon reaching point of engagement 49, the lower peripheral surface of the can is already in contact with rolling surface 19 and 20. The upper peripheral surface then contacts belts **22*a* and 22*b* which are moving in the direction of the arrow referred as 31. This results in a flow of advancing and rotating cans in the direction of the arrow referenced as 32**.

It has been observed that it is undesirable to allow cans to stackup in downward sloping trackwork 50. Such stacking may force cans through the lubricator without rotation of the cans. To prevent stacking and thereby ensure that the cans are rotated by the belts, it is necessary to operate the belts at a speed which will transport cans through the lubricator at a rate equalling or preferably exceeding the rate at which cans are introduced into the downward sloping trackwork. Generally, cans will be introduced to the downward sloping trackwork at about the rate cans are produced by the can line. Where the production line rate is between about 800 and 900 cans per minute, it has been found that the belt speed should be in excess of 480 feet per minute where cans having a nominal diameter of about 2.70 inches are being lubricated.

An airborne mist is produced by supplying pressurized air to fluid atomizer 44. A number of methods for the atomization of liquids are known and many may be suitable for use with the present invention. Excellent results have been obtained with a commercially available micro-fog tool lubrication unit. These units dispense particles of lubricant ranging in size from about 2 microns to about 0.2 microns into a moving air stream. Typical concentrations achieved by these devises are about 1/1000 of an ounce of lubricant to 10 cubic feet of air. The concentration may vary over a wide range depending on air pressure, air flow and the setting on the adjustable micro-fog unit.

The lubricant mist is communicated to manifold 27 by hollow member 34. The mist is then directed through holes 36 to 41 toward the end portion of cans 29 which are being advanced and rotated through the lubricator. The increased diameter of the holes toward the ends of manifold 27 compensate for the pressure drop across the manifold thereby achieving a substantially even distribution of lubricant from each hole.

Generally no further cleaning of the cans will be done prior to filling with a beverage. To avoid contamination of the interior of the cans with lubricant, the outlets are oriented at an angle of inclination as depicted in FIG. 3 and referenced $\alpha$. This angle directs the lubricant away from the interior opening of the can such that any lubricant missing the exterior surface of the can will also avoid the interior. Angle $\alpha$ will generally be between 0° and 25°, or preferably, about 5°.

To ensure that each can is lubricated and to achieve a more uniform coating of lubricant, a leveling means consisting of absorbent material 48, may be employed along rolling surface 19 and 20. The absorbent material performs two functions. Beads which are formed due to the surface tension of the lubricant will be spread as the can is rolled along the strip. Also, any excess lubricant will be taken in and stored in the absorbent material until a subsequent can having a deficient coating is encountered. This lubricant will then be applied to such a can thereby ensuring no unlubricated cans emerge from the lubricator.

When initially starting a brand new lubricator, it may be helpful to lightly oil the strip. Regardless of if this is done or not, upon operation of the lubricator the strip will quickly reach a steady-state condition as to the amount of lubricant stored therein.

A preferred embodiment of the present invention has been described and illustrated herein to illustrate the principles of the invention, but it is understood that numerous modifications may be made without departing from the spirit and scope of the invention.

What is claimed is:

1. An apparatus for applying a lubricant to the outer surface of a circumferential strip at one end of a metal can in preparation for a necking and flanging operation comprising: at least one belt suspended across a lubrication zone and supported therein by an idler pulley and a drive pully; a stationary rolling surface within said lubrication zone wherein said rolling surface is parallel to and spaced apart from said at least one belt; two constraining members positioned parallel to and one on each side of said rolling surface wherein said constraining members are spaced at least one container length apart; an atomizer to produce an airborne mist of lubricant particles when connected to a source of pressurized air and wherein a major portion of said lubricant particles are smaller than about 2 microns; a length of conduit positioned parallel to said belt wherein said conduit is positioned proximate to the path the outer surface of the circumferential strip at one end of the can will travel through said lubrication zone, said conduit being provided with an inlet to receive a stream of moving air carrying said airborne mist of lubricant particles and a plurality of holes on the peripheral surface thereof and facing said path for directing said stream of moving air carrying said airborne mist of lubricant particles from said conduit through said plurality of holes toward and to the outer surface of said circumferential strip and depositing said airborne mist of lubricant particles thereon; and a hollow member providing communication of said stream of moving air carrying said airborne mist of lubricant particles between said atomizer and said conduit.

2. The apparatus described in claim 1 where said inlet is centrally located on said conduit, said conduit is of circular cross-section, said holes are a plurality of about equally spaced and collinear circular holes having an angle of inclination of about 5 degrees, said holes having increasing diameters from the center outwardly toward both ends of said conduit whereby substantially equal quantities of lubricant mist will emerge from each hole and be directed away from the interior of said can thereby reducing the risk of contamination.

3. The apparatus as described in claim 2 including a leveling means situated within said lubrication zone.

4. The apparatus as described in claim 3 where said leveling means is a continuous strip of absorbent material postioned along said path and in contact with the cirucmferential surface at one end of the can when the can is advanced and rotated through said lubrication zone, whereby said absorbent material will spread beads of lubricant and absorb excess lubricant and redistribute the excess lubricant in a uniform manner to subsequent cans.

5. The apparatus described in claim 4 where said absorbent material is a fiberous material.

6. The apparatus described in claim 5 including a means for transporting cans to said rolling surface, a can sensing means associated with said transporting means, and a shut-off valve on said atomizer wherein said shut-off valve is actuated by said can sensing means.

7. The apparatus described in claim 6 wherein said transporting means is a length of downwardly sloping trackwork.

8. Apparatus for depositing a barely tactile fluid coating on a circumferential surface at one end of a cylindrical can comprising: means for advancing and rotating the can through a treating zone; means to dispense airborne fluid particles having an average size under about 2 microns into a stream of moving air; a conduit along the treating zone having an inlet and a plurality of holes along its length wherein said holes are facing said circumferential surface; and means for communicating said stream of moving air carrying said dispensed airborne fluid particles from said dispensing means to said conduit wherein said stream of moving air carrying said dispensed airborne fluid particles will travel through said communicating means to and through said conduit and through said plurality of holes toward and to said circumferential surface whereby said fluid particles will be deposited on said circumferential surface.

9. The apparatus of claim 8 wherein said means to dispense airborne fluid particles is a micro-fog tool lubricator and a concentration is achieved of about 1/1,000 of an ounce of said fluid to about 10 cubic feet of air.

10. A method of applying a uniform and barely tactile coating of lubricant to the outer peripheral surface of a circumferential strip at one end of a beverage can in preparation for a necking and flanging operation, comprising the steps of: dispensing an airborne mist of lubricant particles into a moving stream of air at a concentration of about 1/1,000 ounce of said lubricant to about 10 cubic feet of air, said particles having an average diameter of under about 2 microns; carrying, with a stream of moving air, said mist of particles through a hollow member to and through a conduit positioned along a lubrication zone; rolling cans through said lubrication zone; directing said stream of moving air carrying said mist of particles through a plurality of outlets along said conduit which are at a predetermined angle of inclination and facing the circumferential strip at the end of the can; impinging the outer peripheral surface of the circumferential strip with said stream of moving air carrying said mist of particles; depositing said mist of particles on said peripheral surface of the circumferential strip; and leveling said deposited mist of particles by spreading beads which form on said outer peripheral surface, absorbing excess lubricant from said outer peripheral surface, storing said absorbed lubricant, and depositing said absorbed lubricant on areas of deficiency on said outer peripheral surface.

11. An apparatus for depositing a fluid on a circumferential surface at one end of a cylindrical can comprising: means for advancing and rotating the can through a treating zone; an atomizer for producing an airborne mist of fluid particles when in communication with a source of pressurized air; a conduit, stationed along said treating zone and having an inlet and a plurality of outlets along its length facing said can, for receiving, through said inlet a stream of moving air carrying said airborne fluid particles and for directing said stream of moving air carrying said particles through said plurality of outlets and toward said can thereby depositing said airborne fluid particles on said can; and means for communicating said stream of moving air carrying said airborne mist from said atomizer to the inlet of said conduit whereby said stream of moving air carrying said airborne fluid particles will travel from said atomizer to and through said conduit, and through the plurality of outlets in said conduit toward and to said can.

12. The apparatus as described in claim 11 wherein said conduit has a circular cross-section and said outlets are a plurality of circular holes through the wall of said conduit.

13. The apparatus as described in claim 12 where said advancing and rotating means comprise: a stationary rolling surface extending through the treating zone, two parallel constraining members associated with the rolling surface wherein said members have a distance of at least one can length between them, and an advancing surface positioned parallel to said rolling surface and at distance of about one can diameter away from said rolling surface, whereby the can will be rolled across said rolling surface by contact with said advancing surface and thereby rolled and advanced through the treating zone.

14. The apparatus as described in claim 13 where said rolling surface travels in a direction opposite to and at a slower speed than said advancing surface.

15. The apparatus described in claim 13 where said advancing surface includes at least one belt suspended across said treating zone to advance a can a predetermined distance.

16. The apparatus described in claim 13 where said advancing surface includes a first belt suspended across said treating zone and supported by a first drive pulley at one end and a first idler pulley at the opposite end, a second belt parallel to the first belt and supported by a second drive pulley and a second idler pulley respectively parallel to and of equal diameters to the first drive pulley and the first idler pulley, the first drive pulley and the second drive pulley connected by a drive shaft, whereby both belts will turn simultaneously and advance the can at equal speeds at both points of contact.

17. The apparatus described in claim 16 including a fluid leveling means situated within said treating zone.

18. The apparatus described in claim 17 where said leveling means is a strip of absorbent material along the length of the treating zone and parallel to said rolling surface, said strip being positioned along the treating zone to contact the circumferential surface of the can upon rolling the can through the treating zone, whereby said absorbent material absorbs any excess fluid on the can surface and redistributes such fluid in a uniform manner to a subsequent can.

19. The apparatus described in claim 18 including a can sensing means and a shut-off valve on said mist producing means wherein said shut-off valve is actuated by said can sensing means.

20. A method of depositing a fluid on a narrow circumferential strip at one end of a cylindrical article comprising the steps of: advancing and rotating the article through a treating zone; supplying pressurized air to an atomizer; producing a mist of airborne fluid particles with said atomizer; transporting said airborne fluid particles by a moving air stream through a hollow member to a conduit; directing said moving air stream carrying said airborne fluid particles toward and to said cylindrical article through a plurality of outlets along the length of said conduit and facing said cylindrical article; and depositing said fluid particles on said cylindrical article while advancing and rotating, whereby, said moving air stream travels from said atomizer to and through said conduit and through a plurality of outlets in said conduit toward and to said cylindrical article thereby depositing said fluid particles on said cylindrical article.

21. The method described in claim 20 with the additional step of leveling the deposited mist of fluid.

22. A method of depositing lubricant on a narrow circumferential strip at one end of a can in preparation for a necking and flanging operation, comprising the steps of: supporting the can away from the portion to be necked and flanged; advancing and rotating the can through a lubrication zone; producing a mist of airborne lubricant particles wherein the majority of said particles have a size of under about 2 microns; transporting said mist of airborne lubricant particles with a stream of moving air to and through a conduit having a plurality of holes along its length and facing said narrow circumferential strip; directing said stream of moving air carrying said airborne lubricant particles through said plurality of holes to impinge on said circumferential strip which is to be necked and flanged; and depositing said airborne lubricant particles on said circumferential strip which is to be necked and flanged.

23. The method which is described in claim 22 with the additional step of leveling said deposited mist by placing a thin strip of absorbent material in contact with said circumferential strip while performing said rolling and directing steps.

24. A method of depositing lubricant on a narrow circumferential strip at one end of a can in preparation for a necking and flanging operation, comprising the steps of: supporting the can away from the portion to be necked and flanged; engaging the outer peripheral surface of the can with a moving surface; advancing and rotating the can through a lubrication zone; confining the can to a substantially planar path; producing an airborne mist of lubricant particles having a size under about 2 microns; carrying said mist of lubricant particles with a stream of moving air through a hollow member and to and through a conduit; directing the stream of moving air carrying said mist of lubricant particles through a plurality of holes in said conduit which face said narrow circumferential strip; and depositing said mist of lubricant particles on said circumferential strip.

25. The method described in claim 24 with the additional step of leveling the deposited mist by placing a thin strip of absorbent material in contact with said circumferential strip while performing said directing and advancing and rotating steps.

26. The method described in claim 25 wherein the lubricant is from the group of mineral oils, hydrocarbon waxers, silicate esters, flouroesters, phosphate esters, and chlorofluorocarbon polymers.

* * * * *